US008206677B2

(12) United States Patent
Sellier et al.

(10) Patent No.: US 8,206,677 B2
(45) Date of Patent: Jun. 26, 2012

(54) METHOD OF TREATING A STRUCTURE CONTAINING SODIUM AND A RADIOACTIVE SUBSTANCE

(75) Inventors: Serge Sellier, La Tour d'Aigues (FR); Janick Verdelli, Pertuis (FR); Joel Godlewski, Aix-en-Provence (FR); Michel Soucille, Vinon sur Verdon (FR); Sandrine Poulain, Venelles (FR)

(73) Assignee: Commissariat a l'Energie Atomique Et Aux Energies Alternatives, Paris (FR)

( * ) Notice: Subject to any disclaimer, the term of this patent is extended or adjusted under 35 U.S.C. 154(b) by 4 days.

(21) Appl. No.: 13/001,224

(22) PCT Filed: Jun. 24, 2009

(86) PCT No.: PCT/FR2009/000760

§ 371 (c)(1),
(2), (4) Date: Dec. 23, 2010

(87) PCT Pub. No.: WO2010/007236

PCT Pub. Date: Jan. 21, 2010

(65) Prior Publication Data

US 2011/0098521 A1 Apr. 28, 2011

(30) Foreign Application Priority Data

Jun. 25, 2008 (FR) ..... 08 03541

(51) Int. Cl.
*G21F 9/06* (2006.01)

(52) U.S. Cl. ..... 423/421; 376/416

(58) Field of Classification Search ..... 423/421; 376/416

See application file for complete search history.

(56) References Cited

U.S. PATENT DOCUMENTS 6,175,051 B1 1/2001 Getman

FOREIGN PATENT DOCUMENTS

| | | | |
|---|---|---|---|
| EP | 0245148 A1 | | 11/1987 |
| EP | 0854115 A1 | | 7/1998 |
| FR | 2888231 | * | 1/2007 |
| FR | 2888231 A1 | | 1/2007 |
| JP | 62129795 A | * | 6/1987 |

OTHER PUBLICATIONS

K. Toews et al. "Application of the MEDEC Process to Treat FERMI-1 Sodium-Bonded Spetn Nuclear Fuel". ANL. 2002. URL: http://www.ipd.anl.gov/anlpubs/2002/07/43546.pdf (Jul. 30, 2002) Accessed Oct. 28, 2011.*
Machine translation of FR2888231.*
Machine translation of JR62129795A.*
European Patent Office, International Search Report and Written Opinion, dated Dec. 8, 2009 (9 pgs—French language; ).
European Patent Office, International Search Report, dated Dec. 8, 2009 (3 pgs—English language).

* cited by examiner

*Primary Examiner* — Daniel C McCracken
*Assistant Examiner* — Richard M Rump
(74) *Attorney, Agent, or Firm* — Harris Beach PLLC

(57) ABSTRACT

Method of treating sodium contained in the interconnected open pores of a structure placed in a cladding, the pores furthermore containing a radioactive substance. The method comprises the following successive steps: a) at least two slits are made over the entire length of the cladding; b) the sodium is converted to sodium carbonate by a carbonation reaction by bringing the structure into contact, via the slits, with a reactive gas mixture comprising steam, carbon dioxide and a gas inert with respect to sodium, in such a way that the expansion of the carbonate causes the cladding and the structure to open starting from the slits and results in the carbonation reaction propagating into the structure.

18 Claims, 3 Drawing Sheets

METHOD OF TREATING A STRUCTURE CONTAINING SODIUM AND A RADIOACTIVE SUBSTANCE

CROSS REFERENCE TO RELATED APPLICATIONS

This application is a National Stage filing under 35 U.S.C. §371 of PCT Application No. PCT/FR2009/000760, filed on Jun. 24, 2009. This application also claims the benefit of French Patent Application No. 0803541, filed on Jun. 25, 2008. The entirety of both applications is incorporated herein by reference.

FIELD OF THE INVENTION

This invention pertains to the field of nuclear waste treatment.

In particular, it relates to the treatment of waste containing sodium and a radioactive substance, wherein this waste can be generated, for example, during the process of purifying the primary circuit of a sodium-cooled Fast Neutron Reactor ("Na-FNR").

BACKGROUND OF THE INVENTION

Cesium is one of the main contaminants of sodium used as the coolant in a "Na-FNR" type of nuclear reactor. For safety reasons, it is necessary to extract radioactive cesium isotopes to reduce the radiological activity of sodium during or after the reactor's operational phase. For that purpose, the sodium which has been contaminated by cesium is liquefied and then filtered through a cesium trap.

This trap typically comprises a porous structure protected by a cladding. It may for instance be a reticulated vitreous carbon cartridge known as a "RVC cartridge", as described hereafter.

Although, during the filtration process, the cesium trap retains cesium mainly through adsorption, one of its drawbacks is to also retain some of the sodium in its pores.

The trap then becomes a form of nuclear waste, which presents a dual risk in terms of safety and security:

a chemical risk due to the residual sodium which must be maintained in an inert gas atmosphere (such as argon or nitrogen) so that it does not induce a chemical reaction risk such as, for example, an explosion by contact with water, or ignition with air;

a radiological risk due to the contamination by radioactive isotopes of cesium (in particular cesium 137) which causes this trap to be classified as radioactive waste, thus imposing very strict safety and security levels.

To process such nuclear waste through conventional systems for discarding contaminated waste, the chemical risk should first be suppressed, that is, the residual sodium should be removed from the cesium-containing trap.

However, in the nuclear field, sodium is conventionally treated by means of a hydrolysis reaction (see for example patent application FR 2,598,248). This reaction is most often carried out in a process cell or in an autoclave and mainly comprises reacting sodium in a liquid or solid state with water to produce sodium hydroxide. However, it has the drawback of being difficult to control and of generating liquid waste, which must in turn be processed.

In an attempt to solve these problems, solid sodium can be treated through a carbonation reaction, in which the sodium hydroxide produced by the hydrolysis reaction is thereafter transformed into carbonate by adding carbon dioxide in its gaseous form, according to the following reactions:

$$Na+H_2O \rightarrow NaOH+\tfrac{1}{2}H_2$$

$$CO_2+H_2O \leftrightarrow H_2CO_3$$

$$NaOH+H_2CO_3 \leftrightarrow NaHCO_3+H_2O$$

$$NaOH+NaHCO_3 \leftrightarrow Na_2CO_3+H_2O$$

$$Na_2CO_3+H_2CO_3 \leftrightarrow 2NaHCO_3$$

The carbonation treatment offers the advantage of generating as final waste product carbonate in solid form.

A facility for carrying out a carbonation treatment is described, for example, in patent application FR 2,888,231. In this application, castable sodium is introduced in a liquid state in an enclosure, which comprises a plurality of trays in which sodium solidifies in the form of thin layers before the carbonation reaction is initiated.

Because of the constraint associated with the formation of thin layers, this facility cannot be used for the treatment of poorly accessible sodium, such as the sodium contained in the porous structure of a cesium trap.

In particular, cutting this trap open in order to access the sodium cannot be envisaged, because the aim is on the contrary to restrict handling operations in the presence of a radioactive substance.

Indeed, this substance most often requires working in a containment enclosure under an inert gas, such as in a glove box. However, cutting operations performed therein are delicate because of the inherent difficulty in performing manipulations within such an enclosure. Therefore, it is generally desired to restrict such operations.

Also, such cutting operations may lead to contamination of the cutting tools by the radioactive substance, for instance cesium 137.

SUMMARY OF THE INVENTION

It is accordingly an object of the invention to provide a method of treating a structure comprising a radioactive substance and sodium that is difficult to access, this method offering the advantages, in particular, of being easily controllable, of generating solid wastes which do not require any further treatment and of minimizing the operations to be carried out in the presence of radioactive substance.

The object of the invention is thus to provide a method of treating sodium contained in the interconnected open pores of a structure placed in a cladding, the pores furthermore containing a radioactive substance.

The method comprises the following successive steps:

a) at least two slits are formed over the entire length of the cladding;

b) the sodium is converted to sodium carbonate by a carbonation reaction, by bringing the structure into contact, via the slits, with a reactive gas mixture comprising steam, carbon dioxide and a gas inert with respect to sodium, in such a way that the expansion of the carbonate causes the cladding and the structure to open starting from the slits and results in the carbonation reaction propagating into the structure.

One of the fundamental aspects underlying the treatment method of this invention is that it benefits from the fact that the carbonate formed in the carbonation reaction has a greater volume than the volume initially occupied by the sodium in the pores.

The carbonation reaction is thus carried out in such a way that the volume expansion of carbonate advantageously leads to the opening of the cladding, starting from the previously formed slits within the latter, subsequently followed by that of the structure.

As a result, the contact surface between sodium and the reactive gas mixture increases, thus accelerating the carbonation reaction.

Thanks to the succession of steps comprising opening the structure and accelerating the carbonation reaction, the latter may propagate throughout the structure.

Thus, in spite of the initially reduced accessibility to the sodium contained in the structure's pores, their "open" character (namely the fact that some of these pores communicate with the structure's surface and therefore with the environment) and their "interconnected" character allow the reactive gas mixture to penetrate deep into and throughout the structure. The latter may then be treated by the method of the invention without requiring an additional cutting operation.

This is particularly advantageous because, due to the presence of a radioactive substance, step (a) and/or (b) of the method of the invention is most often carried out within a containment enclosure such as a glove box or a hot cell where it is sought, as mentioned above, to restrict the cutting operations.

Also, because a carbonation reaction is performed, the treatment method of the invention offers the advantage of producing solid wastes only (carbonate and a radioactive substance) and gaseous wastes (hydrogen) which do not require further treatment.

Furthermore, contrary to sodium or sodium hydroxide, carbonate is stable and chemically inert, in particular with respect to air.

Finally, the treatment method according to the invention is easily controllable since the carbonation reaction can be slowed down by reducing the proportion of steam in the reactive gas mixture, or even stopped by replacing this mixture with an inert gas. The generation of heat or hydrogen, and also the dissemination of the radioactive substance, all of which result from the carbonation reaction, can thus be easily limited.

As a result, the method according to this invention is highly secure and paves the way to the treatment of large quantities of sodium.

Combined with its relative implementation simplicity, the method according to this invention also offers the advantage of enabling the treatment of a large number of structures such as cesium traps in a single operation, thus resulting in considerable cost savings.

Therefore, in a particular embodiment, the structure treated by the method of the invention (which is generally a filter member) is composed of reticulated vitreous carbon and/or the radioactive substance it contains comprises at least one of the radioactive isotopes of cesium such as cesium 137. Thus, the method according to the invention is more specifically intended for the treatment of a cesium trap such as a "RVC cartridge". When the structure's cladding to be treated is essentially tubular in shape as is most often the case for a "RVC cartridge", it is preferable to form at least two diametrically opposed slits in step (a) to promote the opening of the cladding and the structure.

The reactive gas mixture which penetrates through the slits and possibly through the ends of the structure preferably consists of, in molar fraction, from 0.5% to 5.5% of steam, from 5% to 25% of carbon dioxide, with the remainder being an inert gas (namely, a chemically inert gas such as a noble gas or nitrogen).

This mixture causes a reaction to take place with the sodium, which results, in particular, in the generation of a carbonate essentially composed of sodium carbonate $Na_2CO_3$ and/or sodium hydrogen carbonate $NaHCO_3$.

More preferably, to optimize the duration of the carbonation treatment, the reactive gas mixture consists of, in molar fraction, from 3.5% to 4% of steam, from 10% to 20% of carbon dioxide, the remainder being an inert gas, possibly raised to a temperature ranging between 35° C. and 45° C.

Other objects, features and advantages of the invention will become more apparent from the following description, which is given by way of non limiting example with reference to the appended FIGS. 1 to 5.

DETAILED DESCRIPTION OF PARTICULAR EMBODIMENTS

Figure 1:
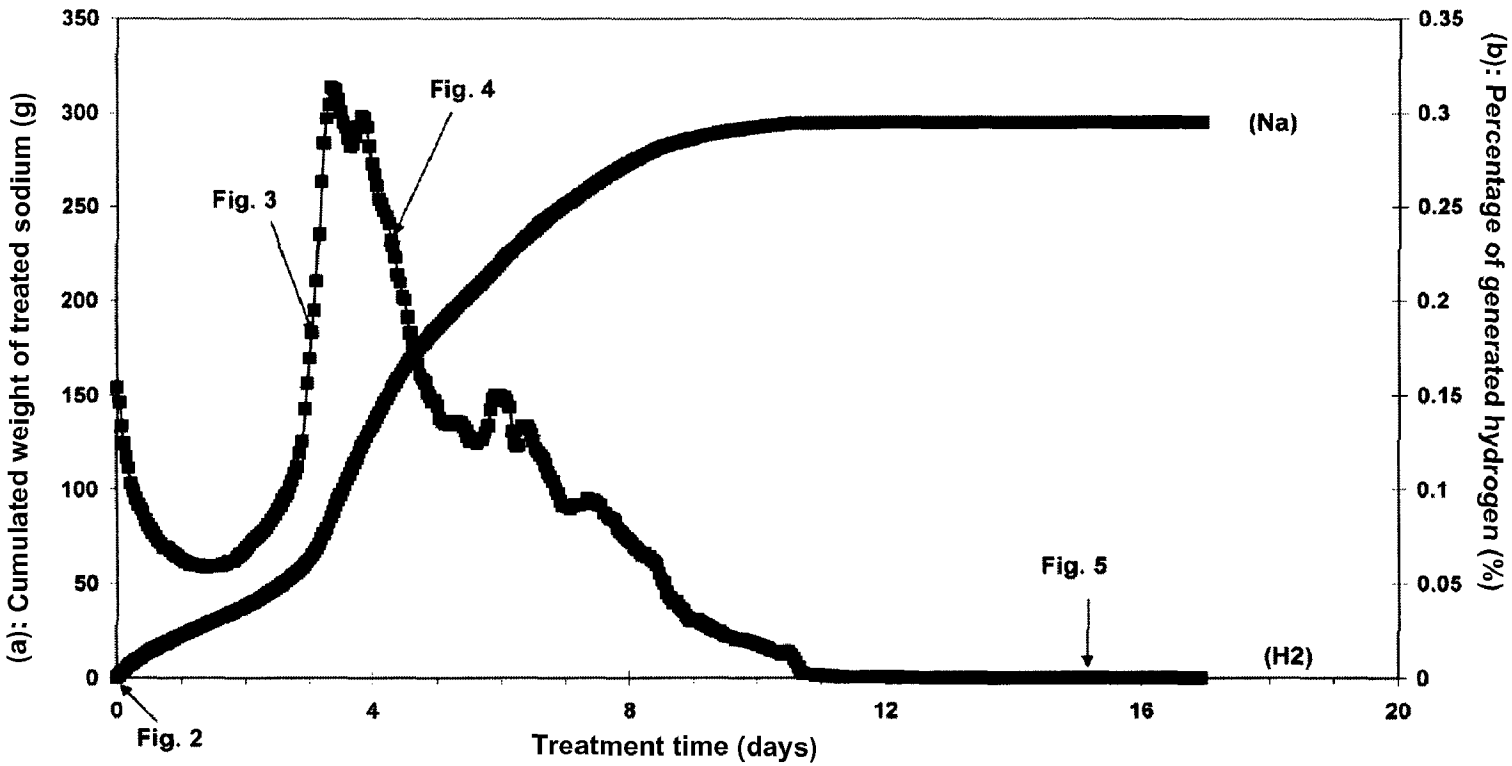
FIG. 1 is a graph showing the evolution of hydrogen generation or sodium consumption during step (b) of the treatment method of the invention.
Figure 2:
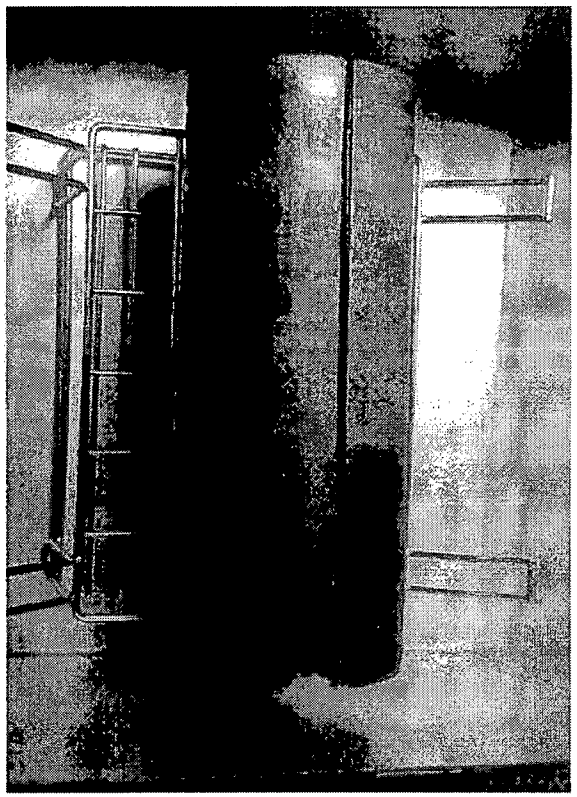
FIGS. 2 to 5 are photographs taken at the different treatment times indicated in FIG. 1.
Figure 3:
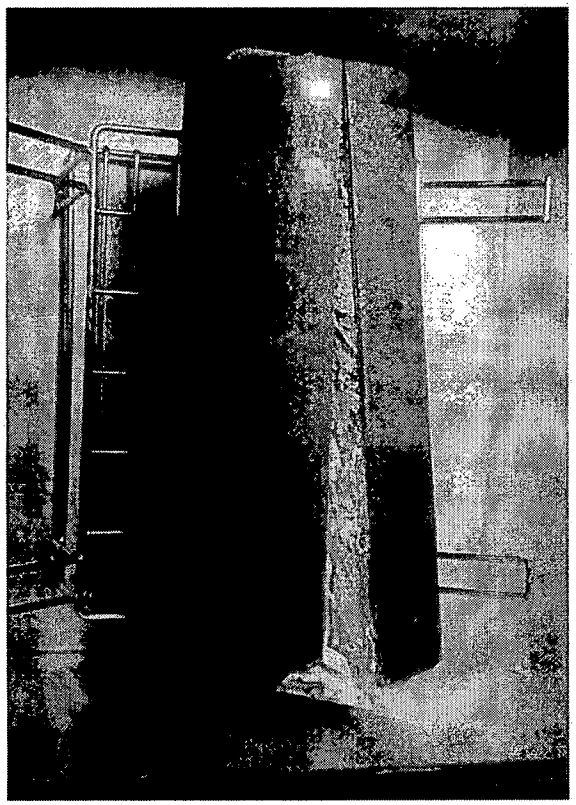
Figure 4:
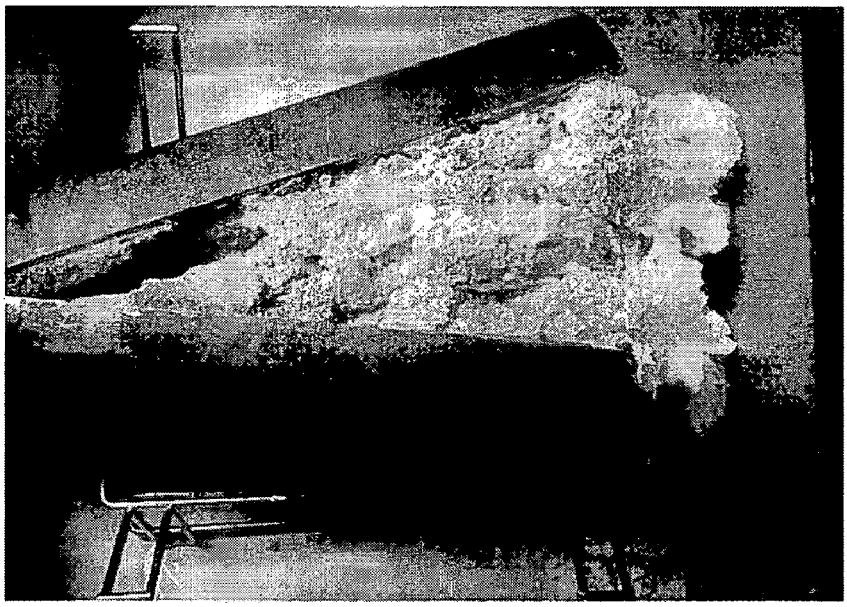

1—Device Suitable for Implementing the Method of the Invention.

The treatment method of the invention is generally carried out in an enclosure enabling the carbonation reaction to be confined. Because of the presence of a radioactive substance within the structure to be treated, this enclosure is generally a glove box.

This enclosure is associated with several units, which perform the following functions:

- mixing the treatment gases in order to obtain a reactive gas mixture,
- analyzing the gas upstream and downstream from the enclosure,
- discarding the gaseous effluents.

The enclosure and its associated units are described hereafter.

1.1—The Treatment Enclosure

This enclosure is intended for the confinement of the carbonation reaction, in particular the radioactive substance which is contained in the structure before and after treatment.

It thus forms an initial barrier, preventing the contamination of the facility in which the method of this invention is implemented.

It generally includes ports and couplings which are required to couple it to a system for preparing the reactive gas mixture and for discharging the gaseous effluents. These ports will preferably be provided with metal filters made of sintered stainless steel (for instance those commercially available from SYNTHERTEC) to prevent extraction of possibly contaminated sodium carbonate dusts.

The structure to be treated may be located within the enclosure on a carrier in order to optimize contact with the reactive gaseous mixture and promote the carbonate-induced expansion.

1.2—Treatment Gas-mixing Unit

The carbonation reaction is carried out with a reactive gas mixture comprising steam, carbon dioxide and a gas which is inert with respect to sodium (preferably nitrogen).

The gas-mixing unit is used for controlling the composition, temperature (and therefore hygrometry), as well as the flow rate of the reactive gas mixture.

The humidity of the gas is lower than the saturation limit, which is determined with safety margins to prevent condensation of water on the walls of the treatment enclosure, the inlet and outlet tubings, and those used for the gas analysis unit. This may require heating of the relevant elements.

These precautions enable the sodium to react slowly when brought in contact with humidity, so as to be converted to sodium hydroxide (NaOH), and to produce limited volumes of hydrogen ($H_2$) that are carried away by the inert gas, which flushes the treatment enclosure. The sodium hydroxide reacts with the carbon dioxide ($CO_2$) to form solid sodium bicarbonate ($NaHCO_3$) and solid sodium carbonate ($Na_2CO_3$).

1.3—Gas Analysis Unit

This unit is used to determine the composition and hygrometry i) of the reactive gas mixture upstream from the treatment enclosure and ii) of the gaseous effluents downstream from the enclosure for monitoring, in particular, the progression of the carbonation reaction.

It typically comprises a chromatograph for measuring the contents of inert gas (such as nitrogen), hydrogen, carbon dioxide or oxygen. The hydrogen content upstream from the treatment enclosure is a good indicator of the completeness of the carbonation reaction.

Another parameter allowing the progression of the carbonation reaction to be monitored is the evolution of the mass of the structure to be treated.

1.4—The Gaseous Effluent Discharge Unit

For a good progression of the carbonation reaction, a continuous refill with the reactive gas mixture must be ensured inside the treatment enclosure.

For that purpose, a device allows the gases to be continuously discharged from the enclosure while maintaining a slight overpressure within the latter.

The associated discharge line is conventionally provided with a check valve and a filtration device to prevent dissemination of radioactive substance into the outside atmosphere.

2—Treatment of a "RVC Cartridge"

2.1—Characteristics of a "RVC Cartridge"

The nuclear industry usually employs a "RVC cartridge" to extract the various radioactive isotopes of cesium (including cesium 137) from the sodium forming the coolant in a nuclear reactor of the "Na-FNR" type.

Such a cartridge generally consists of a structure made of reticulated vitreous carbon (RVC) placed inside a steel tubular cladding closed at its two ends by a filter, which may be entirely or partly removed so that the reactive gas mixture also enters through these ends.

The reticulated vitreous carbon is an open porosity material with a bulk density of approximately 0.06 g/cm$^3$. It comprises interconnected open pores of which 60% have a diameter in the range between 10 and 300 □m.

2.2—Treatment

A part of the primary circuit of a "Na-FNR" reactor is filtered by means of a "RVC cartridge".

After this filtering step, the cartridge contains, in its pores, radioactive cesium and residual sodium.

This cartridge is then placed in a glove box raised to a temperature which depends on the humidity rate used, so as to be treated according to the method of the invention. The treatment temperature generally ranges between 15° C. and 45° C.

By means of a machining tool, such a milling-saw, employed without any lubricant, two diametrically opposed slits are formed along the entire length of the cartridge. These slits are formed through the entire thickness of the tubular cladding and are thus through-going slits, so that the reactive gas mixture is brought into contact with the RVC structure. However, caution is taken to prevent these slits from reaching this structure in order to restrict the contamination of the cutting tool and its surroundings by radioactive cesium.

When appropriate, the welded spots of the cladding are removed by grinding or by means of the cutting tool so as to remove any point of resistance to the subsequent opening of the cartridge caused by the expansion of carbonate ($Na_2CO_3$ and $NaHCO_3$ in the present case).

After this cutting step, the metal cladding is in the form of two half-tubular shells which maintain some cohesion because of the adhesive effect of the sodium in the RVC structure.

To initiate the carbonation reaction, a reactive gas mixture comprising, in molar fraction, between 3.5 and 4% of steam, between 10 and 20% of carbon dioxide, with the remainder being nitrogen, is introduced into the glove box at a continuous flow rate.

The flow rate is such as to maintain within the treatment enclosure an atmospheric composition which promotes a continuous progression of the carbonation reaction. This value generally depends on the volume of the treatment enclosure. In the present case, since the volume is 550 liters, the flow rate is set to 8.7 liters/minute.

The progression of the carbonation reaction is monitored by means of a gas analysis system of the chromatograph type, which measures the hydrogen content (expressed in molar percentage of the generated hydrogen) downstream from the glove box. Based on the hydrogen content, the treated sodium mass (expressed in grams) may be computed as a cumulated value using the stoichiometry coefficients of the reaction forming sodium hydroxide:

$$Na+H_2O \rightarrow NaOH+\mathbf{1};\mathbf{2}H_2.$$

The change over time (expressed in days) of these parameters is shown in FIG. 1. They may vary as a function of the gas mixture composition, of the structure to be treated and of the flow rate at which the gas mixture is introduced into the treatment enclosure.

FIGS. 2, 3, 4 and 5 show photographs taken at different stages of the carbonation reaction (as marked in FIG. 1).

After the reactive gas mixture has been brought into contact with the RVC structure via the slits and through both ends of the structure (FIG. 2), the carbonation reaction will start quickly, as shown by the generation of hydrogen as soon as the treatment begins.

The expansion due to the carbonates formed then causes the semi-tubular shells of the cladding to spread apart and the metal filters inside the cartridge end to be totally freed. The increase in contact surface area between the RVC structure and the reactive gas mixture which follows allows the carbonation reaction to accelerate, which is reflected by a significant increase in generated hydrogen (FIG. 3), and also by an increased expansion of carbonates.

Figure 5:
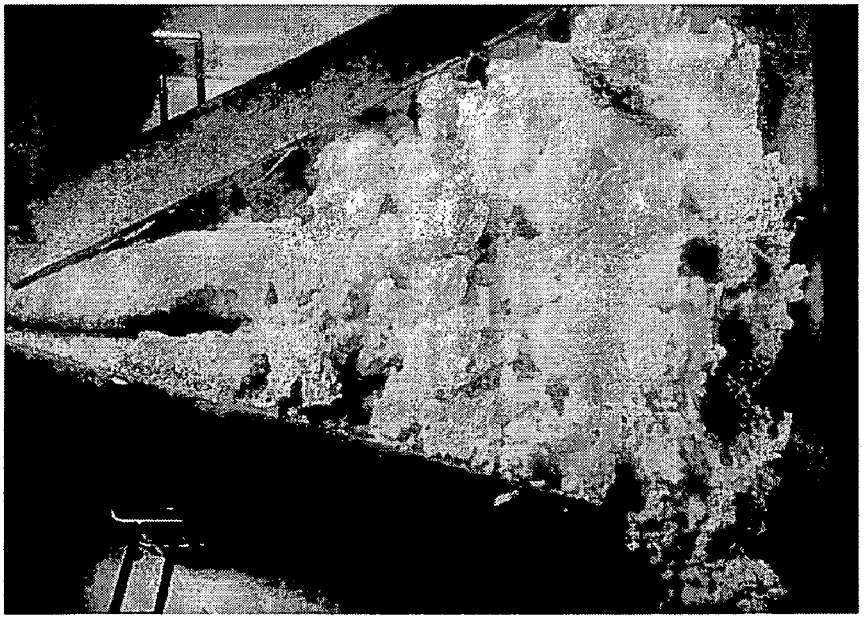

This expansion allows the carbonation reaction to propagate throughout the cartridge through consecutive openings of the RVC structure (FIG. 4) until the sodium initially present in the pores of the RVC structure has been entirely treated (FIG. 5).

Treatment completion may be easily revealed by the absence of hydrogen generation, even though the reactive gas mixture continues to be introduced into the treatment enclosure.

After completion of the treatment method of the invention, the "RVC cartridge" no longer represents a chemical risk. It may now be integrated into the systems conventionally used for discharging contaminated waste in order to eliminate the remaining radiological risk due to the radioactive cesium isotopes.

From the above description, it may be seen that a structure comprising a radioactive substance and poorly accessible sodium may be treated by means of the method of the invention in a controllable manner, while at the same time producing only solid wastes which do not require any subsequent treatment except for those conventionally applied to contaminated wastes.

Because of its secure and simple implementation in spite of the presence of a radioactive substance, as well as the possibility it offers to treat a large number of structures in a single operation, the method of the invention is particularly advantageous, especially when it is sought to treat cesium traps that have been used for the purification of the primary circuit of a "Na-FNR" type of reactor.

The invention claimed is:

1. A method of treating sodium contained in the interconnected open pores of a structure placed in a cladding, the pores furthermore containing a radioactive substance, the process comprising the following successive steps:

a) at least two slits are made over the entire length of the cladding;

b) the said sodium is converted to sodium carbonate by a carbonation reaction by bringing the structure into contact, via the said slits, with a reactive gas mixture comprising steam, carbon dioxide and a gas inert with respect to sodium, in such a way that the expansion of the carbonate causes the cladding and the structure to open starting from the said slits and results in the carbonation reaction propagating into the structure.

2. The treatment method according to claim 1, wherein the said structure is composed of reticulated vitreous carbon.

3. The treatment method according to claim 1, wherein the said radioactive substance comprises at least one of the radioactive isotopes of cesium such as cesium 137.

4. The treatment method according to claim 1, wherein, the said cladding being substantially tubular in shape, at least two diametrically opposed slits are made in step (a).

5. The treatment method according to claim 1, wherein the said reactive gas mixture consists of, in molar fraction, from 0.5% to 5.5% of steam, from 5% to 25% of carbon dioxide, with the remainder being an inert gas.

6. The treatment method according to claim 5, wherein the said reactive gas mixture consists of, in molar fraction, from 3.5% to 4% of steam, from 10% to 20% of carbon dioxide, with the remainder being an inert gas.

7. The treatment method according to claim 1, wherein step (a) and/or (b) is carried out in a confinement enclosure such as a glove box or a hot cell.

8. The treatment method according to claim 2, wherein the said radioactive substance comprises at least one of the radioactive isotopes of cesium such as cesium 137.

9. The treatment method according to claim 2, wherein, the said cladding being substantially tubular in shape, at least two diametrically opposed slits are made in step (a).

10. The treatment method according to claim 3, wherein, the said cladding being substantially tubular in shape, at least two diametrically opposed slits are made in step (a).

11. The treatment method according to claim 2, wherein the said reactive gas mixture consists of, in molar fraction, from 0.5% to 5.5% of steam, from 5% to 25% of carbon dioxide, with the remainder being an inert gas.

12. The treatment method according to claim 3, wherein the said reactive gas mixture consists of, in molar fraction, from 0.5% to 5.5% of steam, from 5% to 25% of carbon dioxide, with the remainder being an inert gas.

13. The treatment method according to claim 4, wherein the said reactive gas mixture consists of, in molar fraction, from 0.5% to 5.5% of steam, from 5% to 25% of carbon dioxide, with the remainder being an inert gas.

14. The treatment method according to claim 2, wherein step (a) and/or (b) is carried out in a confinement enclosure such as a glove box or a hot cell.

15. The treatment method according to claim 3, wherein step (a) and/or (b) is carried out in a confinement enclosure such as a glove box or a hot cell.

16. The treatment method according to claim 4, wherein step (a) and/or (b) is carried out in a confinement enclosure such as a glove box or a hot cell.

17. The treatment method according to claim 5, wherein step (a) and/or (b) is carried out in a confinement enclosure such as a glove box or a hot cell.

18. The treatment method according to claim 6, wherein step (a) and/or (b) is carried out in a confinement enclosure such as a glove box or a hot cell.

* * * * *